US010925313B1

(12) United States Patent
Han et al.

(10) Patent No.: US 10,925,313 B1
(45) Date of Patent: Feb. 23, 2021

(54) ELECTRONIC CIGARETTE WITH AN IMPROVED ATOMIZER

(71) Applicant: CHINA TOBACCO YUNNAN INDUSTRIAL CO., LTD, Kunming (CN)

(72) Inventors: Yi Han, Kunming (CN); Shoubo Li, Kunming (CN); Tinghua Li, Kunming (CN); Donglai Zhu, Kunming (CN); Jun Wu, Kunming (CN); Xia Zhang, Kunming (CN); Xiaowei Gong, Kunming (CN); Wei Zhao, Kunming (CN); Liu Hong, Kunming (CN); Yongkuan Chen, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 16/632,386

(22) PCT Filed: Aug. 8, 2019

(86) PCT No.: PCT/CN2019/099832
§ 371 (c)(1),
(2) Date: Sep. 2, 2020

(87) PCT Pub. No.: WO2020/191987
PCT Pub. Date: Oct. 1, 2020

(30) Foreign Application Priority Data

Mar. 28, 2019 (CN) ..... 201910244930.4

(51) Int. Cl.
*A24F 40/30* (2020.01)
*A24F 40/46* (2020.01)
(Continued)

(52) U.S. Cl.
CPC ..... *A24F 40/30* (2020.01); *A24F 40/10* (2020.01); *A24F 40/46* (2020.01); *H05B 1/0297* (2013.01);
(Continued)

(58) Field of Classification Search
CPC ..... A24F 40/30; A24F 40/10; A24F 40/46; H05B 3/06; H05B 3/10; H05B 3/146;
(Continued)

(56) References Cited

FOREIGN PATENT DOCUMENTS

CN 106376978 A 2/2017
CN 108887754 A 11/2018
(Continued)

*Primary Examiner* — Shawntina T Fuqua
(74) *Attorney, Agent, or Firm* — Bayramoglu Law Offices LLC

(57) ABSTRACT

An electronic cigarette with an improved atomizer includes a suction nozzle and a main body. The main body is provided with an atomizing core mounting groove. The atomizing core mounting groove contains an atomizing core. The suction nozzle and the main body are integrated into one piece, or the suction nozzle and the main body can be connected to or detached from each other. The atomizing core includes a casing, a liquid storage assembly, and a heating assembly. A wire passes through a first wire guide hole and is electrically connected to a power supply and a control system. A first air guide hole and a second air guide hole are connected through which an airflow passes.

8 Claims, 9 Drawing Sheets

(51) Int. Cl.

| | |
|---|---|
| ***A24F 40/10*** | (2020.01) |
| ***H05B 3/10*** | (2006.01) |
| ***H05B 3/14*** | (2006.01) |
| ***H05B 3/03*** | (2006.01) |
| ***H05B 1/02*** | (2006.01) |
| ***H05B 3/06*** | (2006.01) |

(52) U.S. Cl.
CPC ..... *H05B 3/03* (2013.01); *H05B 3/06* (2013.01); *H05B 3/10* (2013.01); *H05B 3/146* (2013.01); *H05B 2203/007* (2013.01); *H05B 2203/013* (2013.01); *H05B 2203/016* (2013.01)

(58) Field of Classification Search
CPC .. H05B 3/03; H05B 1/0297; H05B 2203/016; H05B 2203/007; H05B 2203/013
See application file for complete search history.

(56) References Cited

FOREIGN PATENT DOCUMENTS

| | | | |
|---|---|---|---|
| CN | 109770442 | A | 5/2019 |
| JP | 2019500854 | A | 1/2019 |

ELECTRONIC CIGARETTE WITH AN IMPROVED ATOMIZER

CROSS REFERENCE TO THE RELATED APPLICATIONS

This application is the national phase entry of International Application No. PCT/CN2019/099832, filed on Aug. 8, 2019, which is based upon and claims priority to Chinese Patent Application No. 201910244930.4, filed on Mar. 28, 2019, the entire contents of which are incorporated herein by reference.

TECHNICAL FIELD

The present disclosure belongs to the technical field of electronic cigarettes, and particularly relates to an electronic cigarette with an improved atomizer.

BACKGROUND

Atomizers for electronic cigarettes, in the prior art, include liquid storage cotton type atomizers, liquid storage chamber type atomizers, closed type atomizers, and repeatable e-liquid injection type atomizers, all of which have the following issues: (1) During the use of electronic cigarettes, customers need to replace the atomizer, or refill the e-liquid, in order to change the flavor of the e-liquid. In order to replace the atomizer, multiple atomizers should be provided along with the electronic cigarette. This will increase the size and weight of the entire electronic cigarette, and is inconvenient for consumers to carry around and replace the atomizer at any time. When refilling the e-liquid, in general, only the e-liquid having the same flavor is available to refill the electronic cigarette. This issue produces additional steps for consumers to refill the e-liquid. Consumers are then forced to purchase e-liquids with different flavors to experience different flavors, which increases consumer consumption costs. (2) The properties of the e-liquid in the liquid storage device of the atomizer are unstable when stored and/or in use. The substances, particularly nicotine and the like, are prone to be oxidized and deteriorated, leading to a change of flavor of the e-liquid. As a result, consumers need to replace the atomizer or refill the e-liquid. (3) Currently, a number of consumers are inclined to choose mixed flavors. This method requires the consumer to purchase e-liquids with different flavors to blend the e-liquid for smoking. However, this method is more suitable for regular e-cigarette smokers or those skilled in flavor blending and is difficult to operate for new e-cigarette smokers or those unskilled in flavor blending. (4) The materials, such as the liquid conducting cotton and the liquid storage cotton in the atomizer, are likely to be burnt at a high temperature, which affects the smoking experience and also may pose a health risk.

SUMMARY

The objective of the present disclosure is to provide an electronic cigarette with an improved atomizer, which effectively solves the problems of electronic cigarettes in the prior art of large size resulting in inconvenient carrying, monotony of flavor, unstable e-liquids, burning of the liquid conducting cotton and the liquid storage cotton in the atomizer at high temperatures.

The objective of the present disclosure is achieved by the following technical solutions.

A first aspect of the present disclosure provides an electronic cigarette with an improved atomizer, including:

The suction nozzle 201 and the main body 202; wherein the main body 202 is provided with the atomizing core mounting groove 204, the atomizing core mounting groove 204 contains the atomizing core 100, and the suction nozzle 201 and the main body 202 are integrated into one piece, or the suction nozzle 201 and the main body 202, can be connected to or detached from each other.

The atomizing core 100 includes the casing 101, the liquid storage assembly 102, and the heating assembly 103. The casing 101 is provided with the first wire guide hole 1011 and the first air guide hole 1012. The liquid storage assembly 102 includes the liquid storage chip 1021, the printed circuit board (PCB) 1022, the wire 1023, and the liquid storage chip support 1024. The liquid storage chip support 1024 is provided with the PCB receiving groove 1026 for receiving the PCB 1022. The liquid storage chip 1021 is fixed on the PCB 1022 through the wire 1023. The heating assembly 103 includes the heating element 1031 and the heating element support 1032. The pin 1034 is arranged on the heating element 1031. The heating element support 1032 is provided with the heating element receiving groove 1036 for receiving the heating element 1031 and the second air guide hole 1037. The pin hole 1035 is arranged on a wall of the heating element receiving groove 1036. The pin 1034 passes through the pin hole 1035, so that the heating element 1031 is movably connected to the heating element support 1032. The liquid storage chip 1021 is arranged corresponding to the heating element 1031.

The wire 1023 passes through the first wire guide hole 1011 and is electrically connected to a power supply and a control system. The first air guide hole 1012 and the second air guide hole 1037 are connected through which an airflow passes.

In the present disclosure, the liquid storage chip 1021 is manufactured by using the micro-electromechanical system (MEMS) technology and principle. The material of the liquid storage chip 1021 is silicon or a polymer, wherein silicon is preferably single-crystal silicon, and the polymer is preferably a polymer having a glass transition temperature exceeding 250° C. (typically, e.g. fluoropolymer, polyimide, and high-temperature-resistant polybenzimidazole). The liquid storage chip 1021 includes a plurality of liquid storage chambers 10214, and the volume of the liquid storage chamber 10214 is from a nanoliter scale to a microliter scale. The size of the liquid storage chip 1021, and the number of the liquid storage chambers 10214, can be designed according to the size of the atomizer and the size of the electronic cigarette.

In a preferred embodiment of the present disclosure, the liquid storage chip 1021 includes the following layers in sequence (as shown in FIG. 6): the insulating layer 10212, the silicon substrate layer 10215 or the polymer substrate layer 10221, and the insulating sealing layer 10216. The liquid storage chip 1021 is provided with the plurality of liquid storage chambers 10214 penetrating the insulating layer 10212 and the silicon substrate layer 10215 or the polymer substrate layer 10221. The open end of the liquid storage chamber 10214 is sealed and fixed by a film, and the closed end of the liquid storage chamber 10214 is provided with the e-liquid injection hole 10218.

In a preferred embodiment of the present disclosure, the liquid storage chip 1021 includes the polymer substrate layer 10221 and the insulating sealing layer 10216. The polymer substrate layer 10221 is provided with the plurality of liquid storage chambers 10214 which penetrate the polymer substrate layer 10221. The open end of the liquid storage chamber 10214 is sealed and fixed by the polymer film 10220, and the closed end of the liquid storage chamber 10214 is provided with the e-liquid injection hole 10218.

In a preferred embodiment of the present disclosure, the sealing film used at the open end of the liquid storage chamber 10214 is the metal film 10211 or the polymer film 10220.

In the present disclosure, the external power supply is a lithium battery or other type of rechargeable micro batteries. The control system includes a timer, a signal separator, a microprocessor, an input source (e.g. a memory source), a single-channel receiver, and others. An automatic tester can also be used to allow the power supply to discharge by programming the capacitor voltage. When a decrease in an electric current is detected, the electric current is cut off at a predetermined time, or immediately after triggering the liquid storage chamber.

In a preferred embodiment of the present disclosure, all sealing members and supports are made of high temperature and corrosion resistant insulating materials. When the liquid storage assembly 102 is connected to the heating assembly 103, preferably, the sealing film sealed at the open end of the liquid storage chamber 10214 and the microneedle heating unit 1033 on the heating element 1031 are arranged in a one-to-one correspondence manner.

In a preferred embodiment of the present disclosure, the heating element 1031 is an integral heating element or a heating unit array composed of a plurality of microneedle heating units 1033 which operate independently with one another. The heating element 1031 or the microneedle heating unit 1033 is wire-shaped, line-shaped, or sheet-shaped. The material of the heating element 1031 or the microneedle heating unit 1033 can be an electrothermal material, e.g. a metal heating wire, a metal heating line, a ceramic heating sheet, a folding heating resistor, a semiconductor heating chip, a nano material, and others.

In a preferred embodiment of the present disclosure, the atomizing core 100 can be selectively filled with an e-liquid absorbing material and/or a heat-insulating material.

In a preferred embodiment of the present disclosure, the screw 1013 passes through the first screw hole 1025 and the second screw hole 1038, so that the casing 101 is fixedly connected to the liquid storage assembly 102 and the heating assembly 103.

In a preferred embodiment of the present disclosure, the heating element 1031 includes a non-piercing type heating element and a piercing type heating element. The non-piercing type heating element refers to the heating element 1031 which generates heat after powered on to heat and melt the film sealed at the open end of the liquid storage chamber 10214, and then heats and atomizes the e-liquid 10213 in the liquid storage chamber 10214. The piercing type heating element refers to the heating element 1031 which heats and atomizes the e-liquid 10213 in the liquid storage chamber 10214 after the microneedle heating unit 1033 arranged on the heating element 1031 pierces the film sealed at the open end of the liquid storage chamber 10214.

In a preferred embodiment of the present disclosure, the non-piercing type heating element does not include a piercing mechanism. The non-piercing type heating element achieves a proper heating and atomization effect by adjusting the distance between the liquid storage chip 1021 and the heating element 1031 and then electrochemically dissolving or thermally melting the sealing film at the open end of the liquid storage chamber 10214 by energization to release the e-liquid. The distance is adjusted according to the material of the sealing film (the metal film or the polymer film) at the open end of the liquid storage chamber 10214, the material of the heating element 1031, the heating temperature, power, and the atomization effect of the e-liquid.

In a preferred embodiment of the present disclosure, the piercing type heating element includes a substrate and the plurality of microneedle heating units 1033 protruding on the substrate. The microneedle heating unit 1033 is a conical structure or other hollow structures, and the material of the microneedle heating unit 1033 is silicon or a metal. The diameter of the microneedle heating unit 1033 gradually decreases from the end at the substrate to the end away from the substrate, and the end away from the substrate can pierce the metal film 10211 or the polymer film 10220. The microneedle heating unit 1033 is manufactured by using a MEMS technology, and the inner diameter of the microneedle heating unit 1033 ranges from nanometers to micrometers. The microneedle heating unit 1033 can be fixed on the substrate in a non-retractable manner and can also be fixed on the substrate in a retractable manner. In addition, each microneedle heating unit 1033 can be separately driven to pierce the metal film 10211 or the polymer film 10220 at the corresponding position. When a non-retractable piercing type heating element is selected, after the liquid storage assembly 102 contacts the heating assembly 103, all the microneedle heating units pierce the metal film 10211 or the polymer film 10220. When the piercing type heating element that can be independently retracted and can be separately driven is selected, the retractable microneedle heating unit 1033 can be selectively driven to pierce the metal film 10211 or the polymer film 10220 at the corresponding position.

In the present disclosure, the volume of the liquid storage chamber 10214 can be nanoliter scale to microliter scale, and the inner diameter and the depth of the liquid storage chamber 10214 range from tens of micrometers to hundreds of micrometers. The thickness of the metal film 10211 and the polymer film 10220 ranges from several micrometers to hundreds of micrometers, and the number of the liquid storage chambers 10214 ranges from one to several thousands.

In the present disclosure, the working principle of the atomizing core installed with the metal film silicon-based liquid storage chip is as follows:

(1) For the non-piercing type heating element 1031: the power supply and the control circuit are electrically connected to the non-piercing type heating element 1031 and the liquid storage chip 1021, a voltage is selectively applied to an anode of part or all of the metal films 10211, so that the part or all of the metal films 10211 are electrochemically dissolved to release the e-liquid 10213 in the liquid storage chamber 10214. At the same time, the microneedle heating unit 1033 corresponding to the dissolved metal film 10211 is selected to be powered on to heat and atomize the e-liquid, so as to achieve a fixed-point quantitative release of the e-liquid, which greatly improves the selectivity of the release amount of the e-liquid.

(2) For the piercing type heating element: the power supply and the control circuit are electrically connected to the piercing type heating element 1031 and the liquid storage chip 1021. The microneedle heating unit 1033 is selectively driven to move in a retractable manner to pierce into the metal film 10211, so that the liquid storage chamber 10214 is opened to release the e-liquid 10213. Alternatively, the non-retractable microneedle heating units 1033 are all driven to pierce into the metal film 10211, so that the liquid storage chamber 10214 is opened to release the e-liquid

10213. At the same time, the microneedle heating unit 1033 heats the e-liquid 10213 to achieve a fixed-point quantitative release of the e-liquid, which greatly improves the selectivity of the release amount of the e-liquid.

In the present disclosure, the working principle of the atomizing core installed with the polymer film silicon-based liquid storage chip or the polymer-based liquid storage chip is as follows:

(1) For the non-piercing type heating element: the power supply and the control circuit are electrically connected to the heating element 1031, and part or all of the microneedle heating units 1033 are selected for heating, so that part or all of the polymer films 10220 are heated and melted to release the e-liquid 10213 in the liquid storage chamber 10214, so as to achieve the fixed-point quantitative release of the e-liquid.

(2) For the piercing type heating element: the power supply and the control circuit are electrically connected to the piercing type microneedle heating unit 1033. The microneedle heating unit 1033 is selectively driven to move in a retractable manner to pierce into the polymer film 10220, so that the liquid storage chamber 10214 is opened to release the e-liquid 10213. Alternatively, the non-retractable microneedle heating units 1033 are all driven to pierce into the polymer film 10220, so that the liquid storage chamber 10214 is opened to release the e-liquid 10213. At the same time, the microneedle heating unit 1033 heats the e-liquid 10213 to achieve a fixed-point quantitative release of the e-liquid, which greatly improves the selectivity of the release amount of the e-liquid.

In the present disclosure, the liquid storage chip 1021 can store various forms of the e-liquid, e.g. solid, liquid or gel, and others. In addition, the liquid storage chip 1021 is completely closed without moving parts, which greatly reduces the damage caused by mechanical impact. The open end of the liquid storage chip 1021 is sealed and fixed by the metal film 10211 or the polymer film 10220, and is isolated from the outside environment before the e-liquid is released, so as to prevent the easily oxidized substances (e.g. nicotine) in the e-liquid from being oxidized. Therefore, the e-liquid would not be deteriorated before being smoked by the consumer and thus the flavor would not change.

In the present disclosure, the plurality of liquid storage chambers 10214 are arranged on the liquid storage chip, and the e-liquids 10213 with different flavors can be placed in the liquid storage chambers 10214. A variety of e-liquids 10213 with different flavors are atomized by one atomizer, and thus the smoking experience of the consumer is improved. In addition, the volume of the electronic cigarette is greatly reduced due to a small volume of the atomizing core 100 (approximately 5 mm×5 mm×1 mm or less), and the portability of the electronic cigarette is improved. Furthermore, the structure and device of the atomizing core are more modularized and integrated, which is easy to realize a standardized assembly.

In the traditional method, a liquid guide cotton is used to guide the e-liquid 10213, and then the e-liquid 10213 is heated and atomized by the heating element. The present disclosure employs the non-piercing type heating element 1031 instead, which is configured to electrochemically dissolve or thermally melt the sealing film at the open end of the liquid storage chamber 10214, so that the e-liquid 10213 is heated and atomized. Alternatively, the piercing type heating element is employed to pierce the sealing film at the open end of the liquid storage chamber 10214 to heat and atomize the e-liquid 10213, which avoids the risk that the liquid guide cotton is likely to be burnt at a high temperature when in use.

The present disclosure adopts the MEMS technology, so that the e-liquid 10213 in the liquid storage chamber 10214 can be partially or completely heated and atomized in a selective manner. Consumers can select the e-liquid 10213 with a desired flavor according to their personal preferences to perform heating and atomization, which achieves a personalized smoking experience of the electronic cigarette.

The atomizing core or the components thereof in the present disclosure can be single-use (disposable), and can also be easily disassembled and replaced, which is convenient for consumers. The polymer material in the liquid storage chip can adopt a degradable polymer material, which can cut down the cost and is environmentally friendly.

A second aspect of the present disclosure relates to a method for assembling the electronic cigarette having the improved atomizer, including the following steps:

a. passing the pin 1034 in the heating element 1031 through the pin hole 1035 in the heating element support 1032, so that the heating element 1031 is embedded in the heating element receiving groove 1036 to form the heating assembly 103;

b. fixing the liquid storage chip 1021 on the PCB 1022, wherein the PCB 1022 is electrically connected to the wire 1023; and embedding the PCB 1022 in the PCB receiving groove to form the liquid storage assembly 102; and c. passing the wire 1023 in step b through the first wire guide hole 1011, and then passing the screw 1013 through the first screw hole 1025 and the second screw hole 1038, so that the casing 101 is fixedly connected to the liquid storage assembly 102 and the heating assembly 103.

A third aspect of the present disclosure relates to a method for manufacturing a metal film silicon-based liquid storage chip, including the following steps:

(a). depositing insulating material layers on both sides of the silicon substrate;

(b). performing a photoetching on an insulating material layer on one side to expose the silicon substrate;

(c). performing a chemical etching on the exposed silicon substrate to form the liquid storage chamber 10214;

(d). preparing the conductive metal film 10211 on the surface of the insulating material layer which is not subjected to the photoetching, and using the conductive metal film 10211 as an anode layer;

(e). forming a cathode layer around the anode;

(f). removing the insulating material layer at the bottom of the liquid storage chamber 10214;

(g). adding the e-liquid 10213 to the liquid storage chamber 10214; and (h). sealing the open end of the liquid storage chamber 10214 with the insulating layer 10216 to obtain the metal film silicon-based liquid storage chip containing the e-liquid 10213.

In the above-mentioned preparation steps, in step (h), the liquid storage chamber 10214 is sealed with the insulating layer 10216, the metal film 10211 is used as the anode, and the insulating material layer separating the metal film is used as the cathode.

In the present disclosure, the liquid storage chamber can be filled with e-liquid by means of injection, inkjet printing or spin coating. The liquid storage chamber 10214 is sealed by wafer bonding or other methods. A micro liquid level sensor, a flow sensor, a viscosity sensor, a temperature sensor, and others can be arranged inside the liquid storage chip 1021 to monitor a change of the properties of the e-liquid in the liquid storage chamber, so as to control the circuit to be turned on or turned off or control the magnitude of the voltage or the electric current applied to the electrode. The surface of the metal film 10211 may be covered with a protective layer such as a ceramic layer to protect the circuit inside the chip.

In the present disclosure, the silicon-based liquid storage chip includes a metal film silicon-based liquid storage chip and a polymer film silicon-based liquid storage chip according to the material used in the sealing film of the liquid storage chamber. The metal film silicon-based liquid storage chip uses the metal film 10211 as the sealing film of the liquid storage chamber 10214. The metal film 10211 is made of a thin film of a conductive material, e.g. copper, gold, silver, zinc, platinum or titanium. The release of the e-liquid can be controlled by a mechanical method, an electronic method, magnetism, laser or other methods. The polymer film silicon-based liquid storage chip uses the polymer film 10220 as the sealing film of the liquid storage chamber 10214, and the polymer film 10220 is made of a degradable copolymer material, e.g. poly (lactic-co-glycolic acid) (PLGA). The release of the e-liquid can be controlled by a mechanical method or thermal melting, and other methods.

In a preferred embodiment of the present disclosure, the substrate material can also be a ceramic, a semiconductor, polyimide, silicone rubber, parylene, polyethylene terephthalate, silicone resin, and others, wherein polysilicon, single-crystal silicon, glass or plastic materials are suitable for etching or machining, and silicon is preferably used as the substrate material in the present disclosure.

In the present disclosure, the liquid storage chamber 10214 can be formed by etching or machining, and the shape of the liquid storage chamber 10214 can be a tetragonal pyramid or a cone. According to the required geometric configuration, the metal is deposited at the open end of the liquid storage chamber 10214 to obtain the metal film 10211 which is used as the sealing film, the metal film 10211 controls the releasing time of the e-liquid 10213 which is released from the liquid storage chamber 10214, and the metal film 10211 is used as the anode. The present disclosure controls the release of the e-liquid 10213 in the liquid storage chamber 10214 through a mechanical method, an electronic method, magnetism, laser or other methods. When the metal film 10211 is used as the sealing film, the present disclosure employs the piercing type heating element (piercing and thermally melting the metal film) or the non-piercing type heating element (electrochemically dissolving the metal film) to open the metal film 10211. When the polymer is used as the sealing film of the open end of the liquid storage chamber 10214, the e-liquid 10213 in the liquid storage chamber 10214 is controlled to release by piercing and thermal melting (the piercing type heating element) or non-piercing type thermal melting (the non-piercing type heating element).

In a preferred embodiment of the present disclosure, piercing and thermal melting means using the microneedle heating unit 1033 protruding from the piercing type heating element 1031 to pierce the metal film 10211 or the polymer film 10220 corresponding to the microneedle heating unit 1033. The e-liquid 10213 in the liquid storage chamber 10214 flows into the hollow flow channel of the microneedle heating unit 1033 and is heated and atomized. In the electrochemical dissolution method, a voltage is applied between the metal film 10211 (anode) and the cathode 10212, to allow the metal film 10211 to be dissolved and opened, and the e-liquid 10213 in the liquid storage chamber 10214 is atomized in the liquid storage chamber 10214 or flows into the surface of the non-piercing type heating element to be heated and atomized under the heating of the non-piercing type heating element. In the non-piercing thermal melting method, the polymer film 10220 absorbs heat from the non-piercing type heating element to be broken and melted, and the e-liquid 10213 in the liquid storage chamber 10214 is heated and atomized or flows into the surface of the heating element to be heated and atomized.

In the present disclosure, the cathode can be designed with different sizes and layouts according to the control method of the device and electrode. The insulating layer 10212 on the entire surface of the liquid storage chip 1021 can be used as the cathode. The metal film (anode) 10211 and the cathode together form a liquid storage chip circuit. The control method of the electrode includes a constant voltage control method and a constant current control method. In the constant voltage control method, the voltage is kept constant during the opening of the metal film 10211. In the constant current control, the current is kept constant during the opening of the metal film 10211. Each metal film is separately connected to the cathode and anode of the power supply.

In the present disclosure, the e-liquid 10213 is atomized in the hollow flow channel of the microneedle heating unit 1033, atomized in the liquid storage chamber 10214, or atomized on the surface of the heating element 1031, which is related to the properties (e.g. viscosity, boiling point, and weight) of the e-liquid 10213, the friction force and surface tension between the e-liquid 10213 and the inner wall of the hollow flow channel of the microneedle heating unit 1033 or the inner wall of the liquid storage chamber 10214, the heating temperature of the heating element 1031, the distance between the heating element 1031 and the liquid storage chip 1021, and other factors.

In the present disclosure, the e-liquid 10213 in the liquid storage chamber 10214 can be solid, liquid, or gel. The flavor of the e-liquid 10213 in the liquid storage chamber 10214 can be one type or multiple types.

A fourth aspect of the present disclosure relates to a method for manufacturing the polymer film silicon-based liquid storage chip, including the following steps:

(a), depositing insulating material layers on both sides of the silicon substrate;

(b), performing a photoetching on an insulating material layer on one side to expose the silicon substrate;

(c), performing a chemical etching on the exposed silicon substrate to form the liquid storage chamber 10214;

(d), injecting a solution of the polymer film 10220 and the e-liquid 10213 into the liquid storage chamber 10214;

(e), sealing the e-liquid injection hole of the liquid storage chamber 10214 with the insulating sealing film 10216 to obtain the polymer film silicon-based liquid storage chip containing the e-liquid 10213;

(f) removing the insulating material layer at the polymer film 10220 of the liquid storage chamber 10214.

A fifth aspect of the present disclosure relates to a method for manufacturing the polymer-based liquid storage chip, including the following steps:

(a), pressing an aluminum template on the polymer substrate to form the tapered liquid storage chamber 10214;

(b-c), obtaining a truncated cone shaped liquid storage chamber having an opening at each end after polishing the polymer substrate;

(d), injecting the solution of the polymer film 10220 through the relatively small opening of the liquid storage chamber 10214; then, (e), adding the e-liquid 10213 to the liquid storage chamber 10214; and (f), sealing the relatively large opening of the liquid storage chamber 10214 with the insulating sealing layer 10216 to obtain the polymer-based liquid storage chip containing the e-liquid 10213.

In the present disclosure, the polymer film 10220 can employ a degradable copolymer such as PLGA. The performance of the liquid storage chip can be adjusted by changing the characteristics (e.g. the size and the polymer type) of the device, the number and volume of the liquid storage chambers, and the properties of the liquid storage chamber film (e.g. film thickness, weight, material, and copolymer ratio, etc.), which is adapted to different electronic cigarettes and different consumers.

The present disclosure has the following advantages:

1. In the present disclosure, the liquid storage chip can store various forms of the e-liquid, e.g. solid, liquid or gel, and others. In addition, the liquid storage chip is completely closed without moving parts, which greatly reduces the damage caused by mechanical impact. The open end of the liquid storage chip is sealed and fixed by the metal film or the polymer film, and the liquid storage chip is isolated from the outside environment before the e-liquid is released, so as to prevent the easily oxidized substances (e.g. nicotine) in the e-liquid from being oxidized. Therefore, the e-liquid would not be deteriorated before being smoked by the consumer and thus the flavor would not change.

2. In the present disclosure, the plurality of liquid storage chambers are arranged on the liquid storage chip, and the e-liquids with different flavors can be placed in the liquid storage chambers. A variety of e-liquids with different flavors are atomized by one atomizer, and thus the smoking experience of the consumer is improved. In addition, the volume of the electronic cigarette is greatly reduced due to a small volume of the atomizing core (approximately 5 mm×5 mm×1 mm or less), and the portability of the electronic cigarette is improved. Furthermore, the structure and device of the atomizing core are more modularized and integrated, which is easy to realize a standardized assembly.

3. In the traditional method, a liquid guide cotton is used to guide the e-liquid, and then the e-liquid is heated and atomized by the heating element. The present disclosure employs the non-piercing type heating element instead, which is configured to electrochemically dissolve or thermally melt the sealing film at the open end of the liquid storage chamber, so that the e-liquid is heated and atomized. Alternatively, the piercing type heating element is employed to pierce the sealing film at the open end of the liquid storage chamber 10214 to heat and atomize the e-liquid, which avoids the risk that the liquid guide cotton is likely to be burnt at a high temperature when in use.

4. The present disclosure adopts the MEMS technology, and the e-liquid in the liquid storage chamber can be partially or completely heated and atomized in a selective manner, in that each metal film is separately connected to the cathode and anode of the power supply, or each microneedle heating unit can operate independently of one another. Consumers can select the e-liquid with a desired flavor according to their personal preferences to perform heating and atomization, which achieves a personalized smoking experience of the electronic cigarette.

5. The atomizing core or the components thereof in the present disclosure can be single-use (disposable), and can also be easily disassembled and replaced, which is convenient for consumers. The polymer material in the liquid storage chip can adopt a degradable polymer material, which can cut down the cost and is environmentally friendly.

Figure 1:
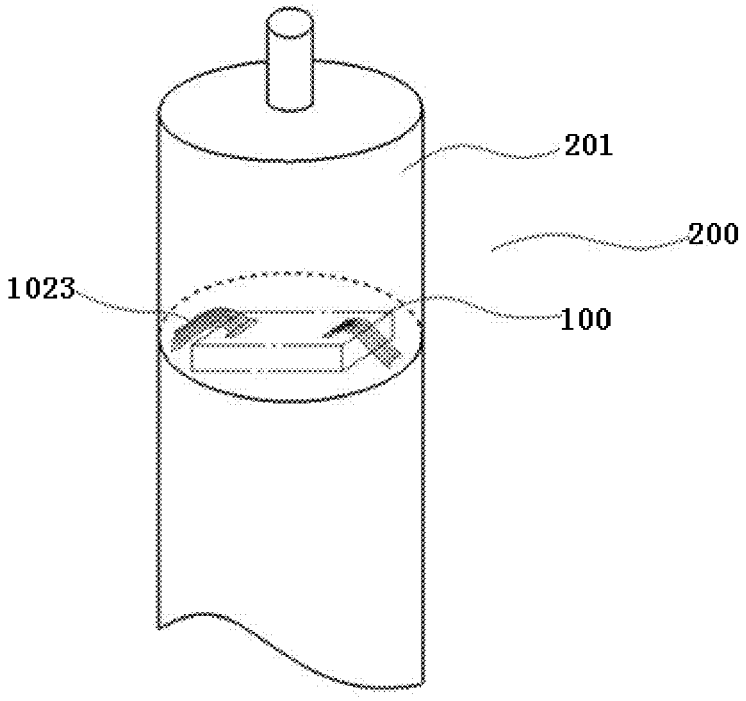
FIG. 1 is a schematic diagram showing the overall structure of the device of the present disclosure.
Figure 2:
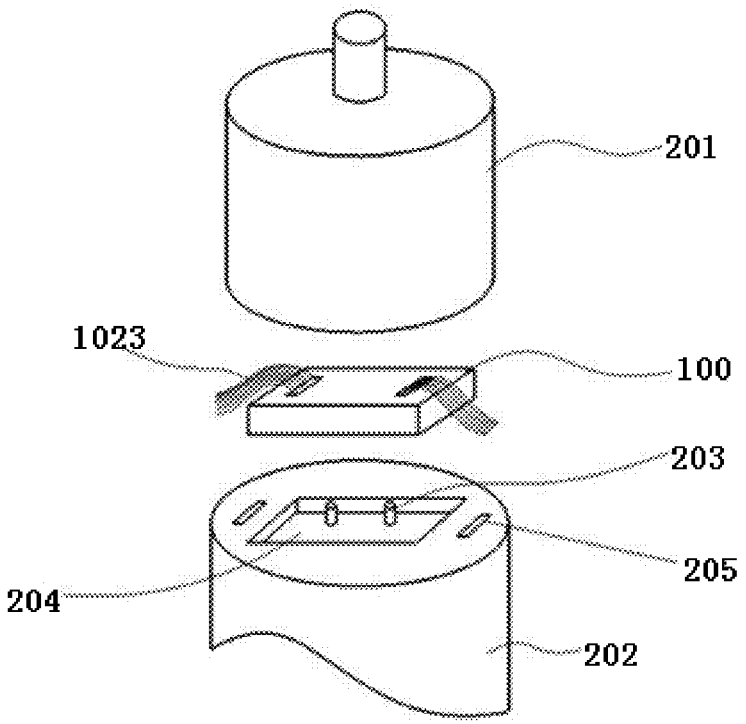
FIG. 2 is an exploded view showing the structure of the device of the present disclosure.
Figure 3:
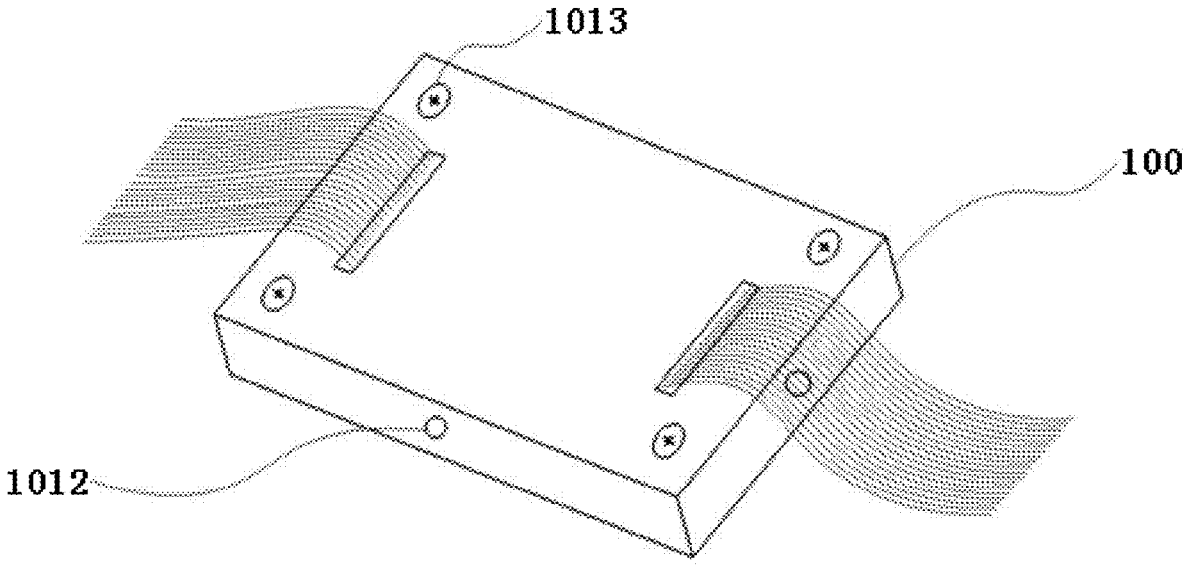
FIG. 3 is a schematic diagram showing the overall structure of the atomizing core of the device of the present disclosure.
Figure 4:
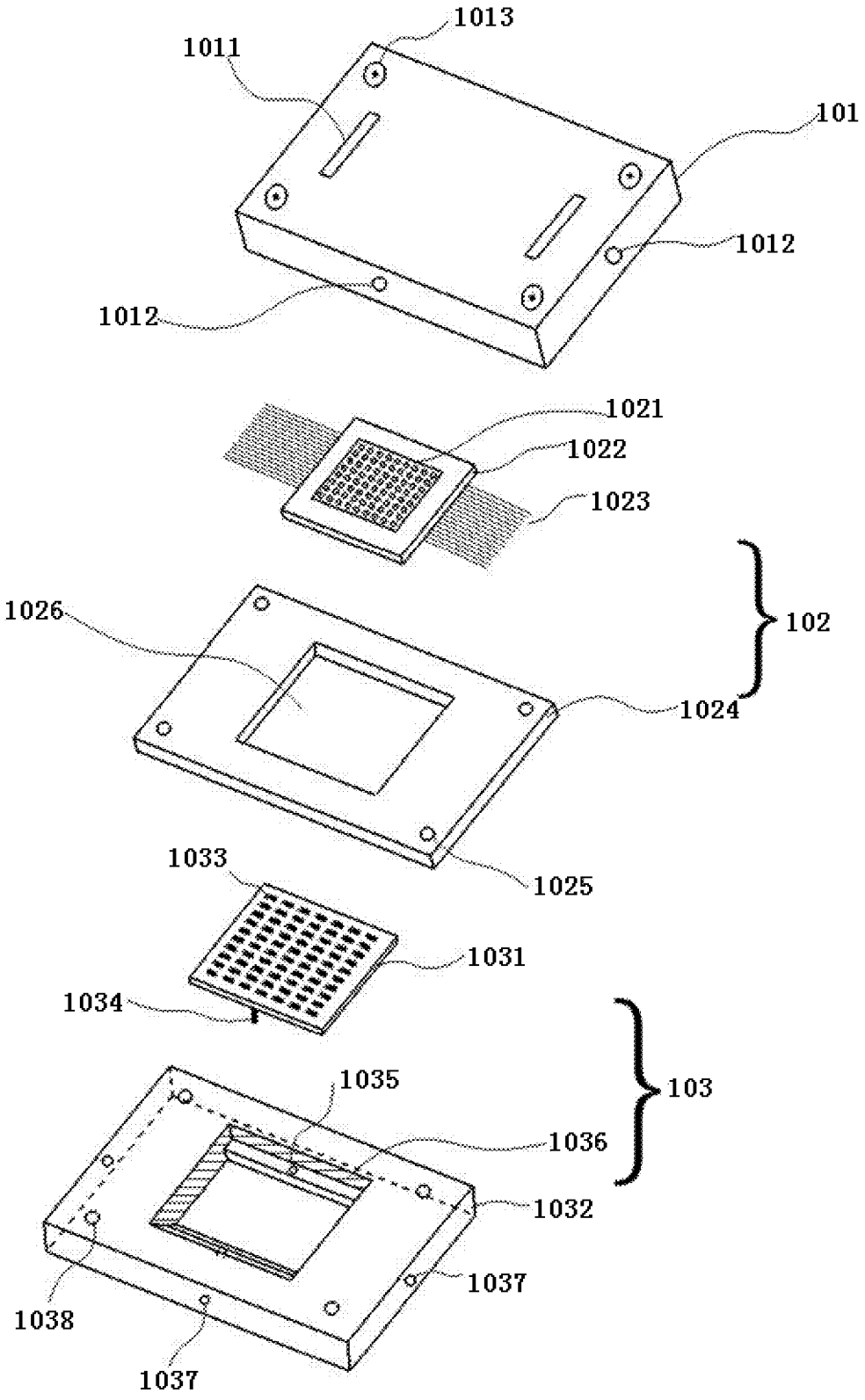
FIG. 4 is an exploded view showing the structure of the atomizing core of the device of the present disclosure.
Figure 5:
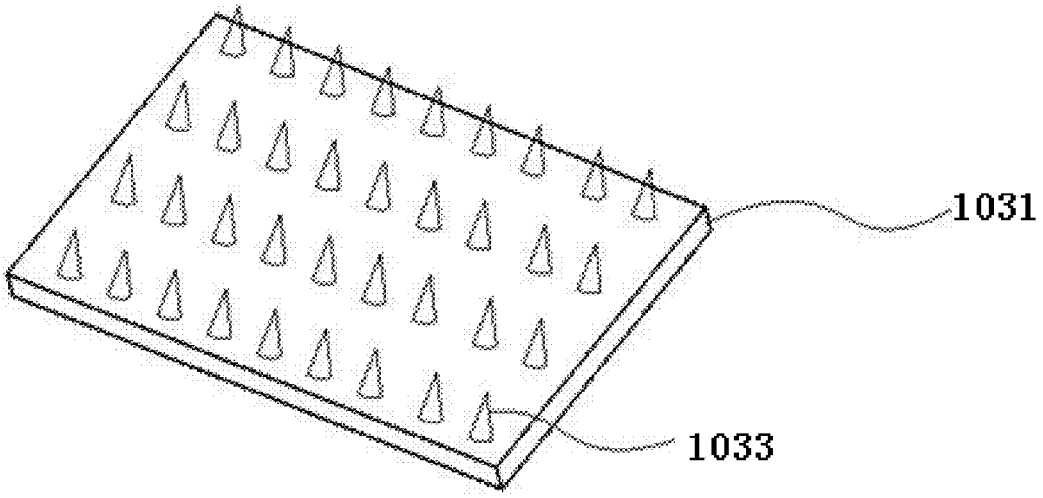
FIG. 5 is a structural schematic diagram of the piercing type heating element of the device of the present disclosure.

In the drawings: 100—atomizing core, 101—casing, 1011—first wire guide hole, 1012—first air guide hole, 1013—screw; 102—liquid storage assembly, 1021—liquid storage chip, 10211—metal film, 10212—insulating layer, 10213—e-liquid, 10214—liquid storage chamber, 10215—silicon substrate layer, 10216—insulating sealing layer, 10217—liquid storage chamber sidewall, 10218—e-liquid injection hole, 10219—metal conductive path, 10220—polymer film, 10221—polymer substrate layer, 1022—PCB, 1023—wire, 1024—liquid storage chip support, 1025—first screw hole, 1026—PCB receiving groove, 103—heating assembly, 1031—heating element, 1032—heating element support, 1033—microneedle heating unit, 1034—pin, 1035—pin hole, 1036—heating element receiving groove, 1037—second air guide hole, 1038—second screw hole, 200—atomizer, 201—suction nozzle, 202—main body, 203—electrode needle, 204—atomizing core mounting groove, 205—second wire guide hole, 3—polymer substrate, 4—aluminum template.

DETAILED DESCRIPTION OF THE EMBODIMENTS

The following embodiments are intended to illustrate the content of the present disclosure rather than limiting the scope of protection of the present disclosure.

Embodiment 1

The present embodiment relates to the electronic cigarette with the improved atomizer, including:

the suction nozzle 201 and the main body 202. The main body 202 is provided with the atomizing core mounting groove 204. The atomizing core mounting groove 204 contains the atomizing core 100. The suction nozzle 201 and the main body 202 are integrated into one piece, or the suction nozzle 201 and the main body 202 can be connected to or detached from each other.

The atomizing core 100 includes the casing 101, the liquid storage assembly 102, and the heating assembly 103. The casing 101 is provided with the first wire guide hole 1011 and the first air guide hole 1012. The liquid storage assembly 102 includes the liquid storage chip 1021, the printed circuit board (PCB) 1022, the wire 1023, and the liquid storage chip support 1024. The liquid storage chip support 1024 is provided with the PCB receiving groove 1026 for receiving the PCB 1022. The liquid storage chip 1021 is fixed on the PCB 1022 through the wire 1023. The heating assembly 103 includes the heating element 1031 and the heating element support 1032. The pin 1034 is arranged on the heating element 1031. The heating element support 1032 is provided with the heating element receiving groove 1036 for receiving the heating element 1031 and the second air guide hole 1037. The pin hole 1035 is arranged on the wall of the heating element receiving groove 1036. The pin 1034 passes through the pin hole 1035, so that the heating element 1031 is movably connected to the heating element support 1032. The liquid storage chip 1021 is arranged corresponding to the heating element 1031.

The wire 1023 passes through the first wire guide hole 1011 and is electrically connected to the power supply and the control system. The first air guide hole 1012 and the second air guide hole 1037 are connected through which an airflow passes.

Figure 6A:
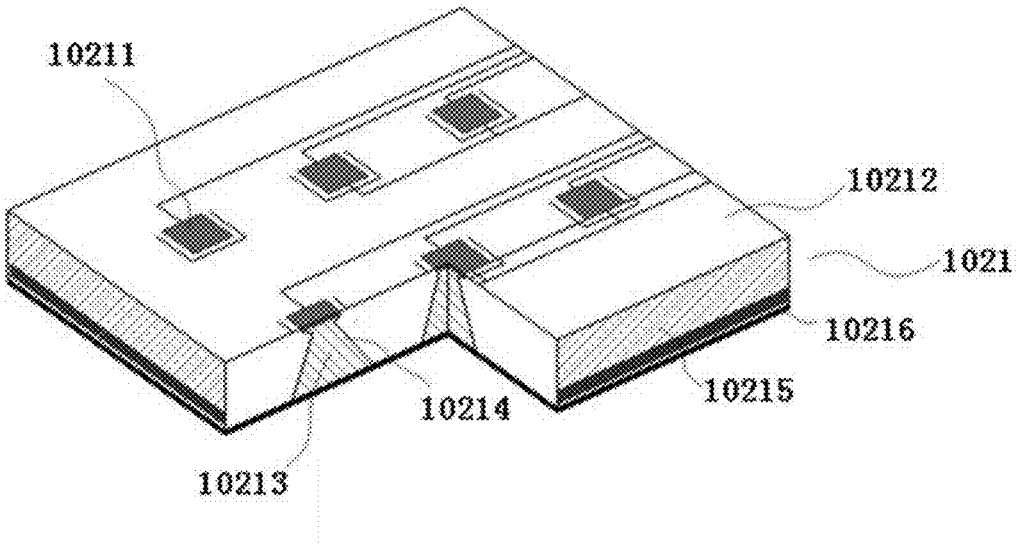
FIG. 6A is a structural schematic diagram of the silicon-based liquid storage chip according to embodiment 1.
Figure 6B:
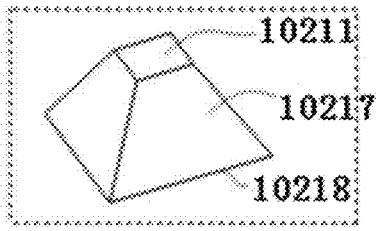
FIG. 6B is an enlarged view showing the structure of the liquid storage chamber in FIG. 6A.

In the present embodiment, the liquid storage chip 1021 includes the following layers in sequence (as shown in FIG. 6): the insulating layer 10212, the silicon substrate layer 10215, and the insulating sealing layer 10216. The liquid storage chip 1021 is provided with a plurality of liquid storage chambers 10214 penetrating the insulating layer 10212 and the silicon substrate layer 10215. The open end of the liquid storage chamber 10214 is sealed and fixed by the metal film, and the closed end of the liquid storage chamber 10214 is provided with the e-liquid injection hole 10218.

In the present embodiment, the conductive path connected to the metal film 10211 is embedded under the insulating layer 10212.

Embodiment 2

The present embodiment relates to the electronic cigarette with the improved atomizer, including:

the suction nozzle 201 and the main body 202. The main body 202 is provided with the atomizing core mounting groove 204. The atomizing core mounting groove 204 contains the atomizing core 100. The suction nozzle 201 and the main body 202 are integrated into one piece, or the suction nozzle 201 and the main body 202 can be connected to or detached from each other.

The atomizing core 100 includes the casing 101, the liquid storage assembly 102, and the heating assembly 103. The casing 101 is provided with the first wire guide hole 1011 and the first air guide hole 1012. The liquid storage assembly 102 includes the liquid storage chip 1021, the PCB 1022, the wire 1023, and the liquid storage chip support 1024. The liquid storage chip support 1024 is provided with the PCB receiving groove 1026 for receiving the PCB 1022. The liquid storage chip 1021 is fixed on the PCB 1022 through the wire 1023. The heating assembly 103 includes the heating element 1031 and the heating element support 1032. The pin 1034 is arranged on the heating element 1031. The heating element support 1032 is provided with the heating element receiving groove 1036 for receiving the heating element 1031 and the second air guide hole 1037. The pin hole 1035 is arranged on the wall of the heating element receiving groove 1036. The pin 1034 passes through the pin hole 1035, so that the heating element 1031 is movably connected to the heating element support 1032. The liquid storage chip 1021 is arranged corresponding to the heating element 1031.

The wire 1023 passes through the first wire guide hole 1011 and is electrically connected to the power supply and the control system. The first air guide hole 1012 and the second air guide hole 1037 are connected through which an airflow passes.

Figure 7:
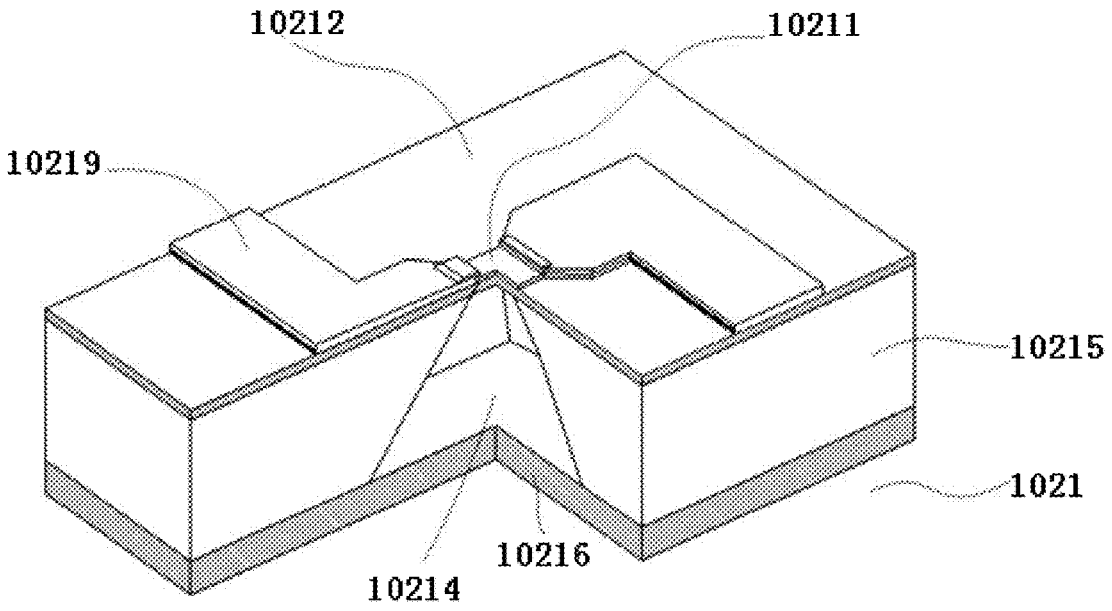
FIG. 7 is a structural schematic diagram of the silicon-based liquid storage chip according to embodiment 2.
Figure 8:
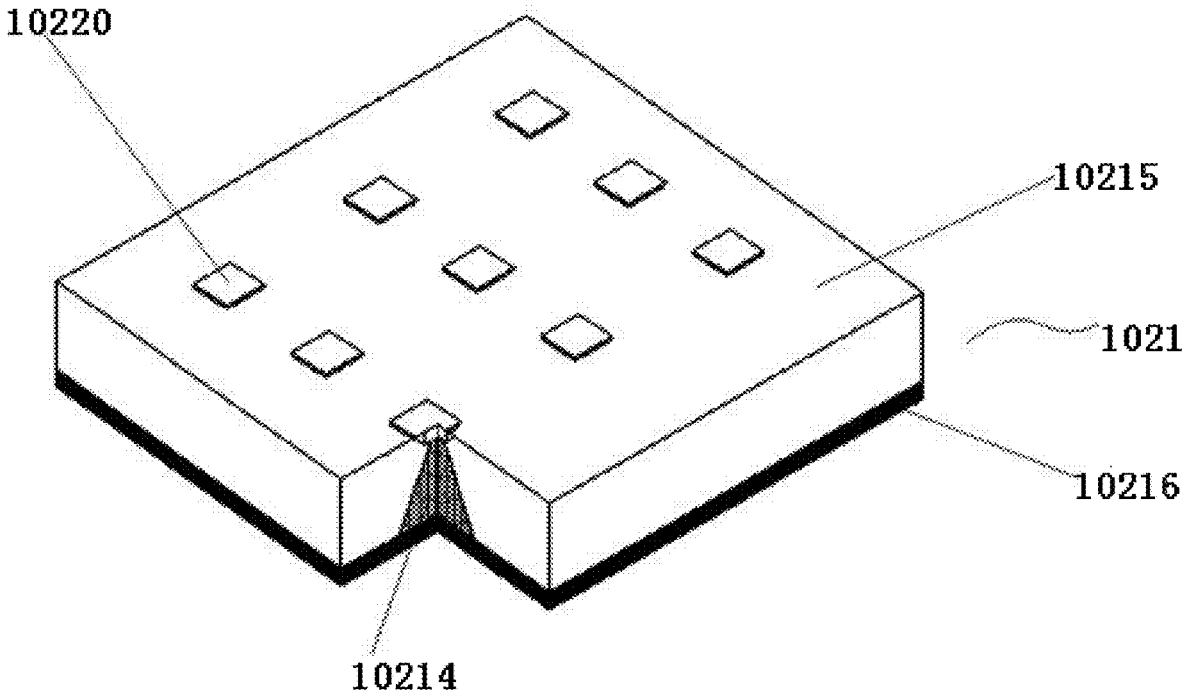
FIG. 8 is a structural schematic diagram of the silicon-based liquid storage chip according to embodiment 3.

In the present embodiment, the liquid storage chip 1021 includes the following layers in sequence (as shown in FIG. 7): the insulating layer 10212, the silicon substrate layer 10215, and the insulating sealing layer 10216. The liquid storage chip 1021 is provided with a plurality of liquid storage chambers 10214 penetrating the insulating layer 10212 and the silicon substrate layer 10215. The open end of the liquid storage chamber 10214 is sealed and fixed by the metal film, and the closed end of the liquid storage chamber 10214 is provided with the e-liquid injection hole 10218.

In the present embodiment, the conductive path connected to the metal film 10211 is embedded above the insulating layer 10212.

Embodiment 3

The present embodiment relates to the electronic cigarette with the improved atomizer, including:

the suction nozzle 201 and the main body 202. The main body 202 is provided with the atomizing core mounting groove 204. The atomizing core mounting groove 204 contains the atomizing core 100. The suction nozzle 201 and the main body 202 are integrated into one piece, or the suction nozzle 201 and the main body 202 can be connected to or detached from each other.

The atomizing core 100 includes the casing 101, the liquid storage assembly 102, and the heating assembly 103. The casing 101 is provided with the first wire guide hole 1011 and the first air guide hole 1012. The liquid storage assembly 102 includes the liquid storage chip 1021, the PCB 1022, the wire 1023, and the liquid storage chip support 1024. The liquid storage chip support 1024 is provided with the PCB receiving groove 1026 for receiving the PCB 1022. The liquid storage chip 1021 is fixed on the PCB 1022 through the wire 1023. The heating assembly 103 includes the heating element 1031 and the heating element support 1032. The pin 1034 is arranged on the heating element 1031. The heating element support 1032 is provided with the heating element receiving groove 1036 for receiving the heating element 1031 and the second air guide hole 1037. The pin hole 1035 is arranged on the wall of the heating element receiving groove 1036. The pin 1034 passes through the pin hole 1035, so that the heating element 1031 is movably connected to the heating element support 1032. The liquid storage chip 1021 is arranged corresponding to the heating element 1031.

The wire 1023 passes through the first wire guide hole 1011 and is electrically connected to the power supply and the control system. The first air guide hole 1012 and the second air guide hole 1037 are connected through which an airflow passes.

Figure 9A:
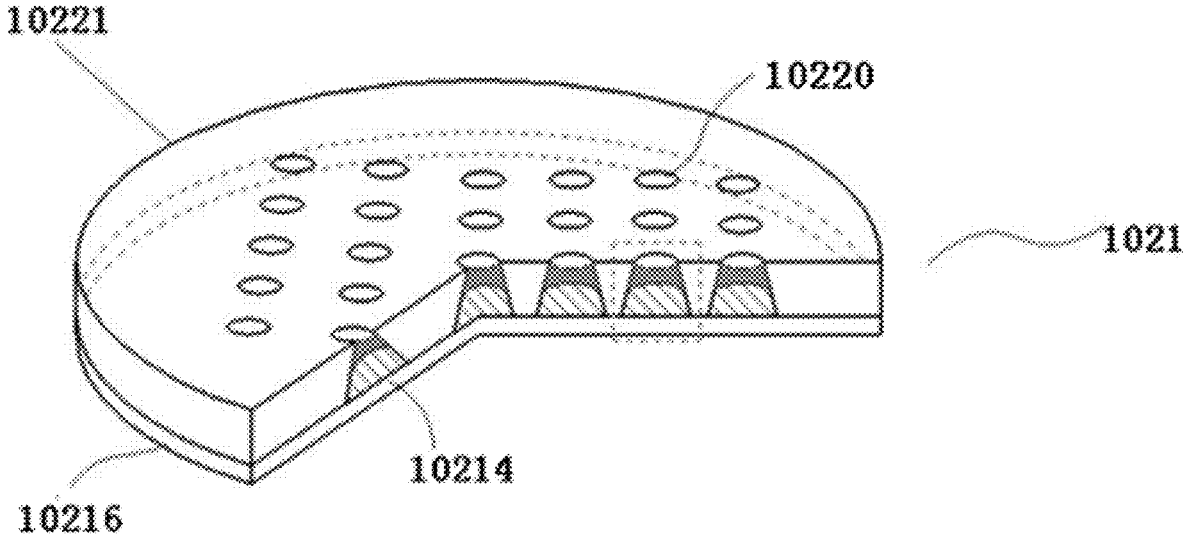
FIG. 9A is a structural schematic diagram of the polymer-based liquid storage chip.
Figure 9B:
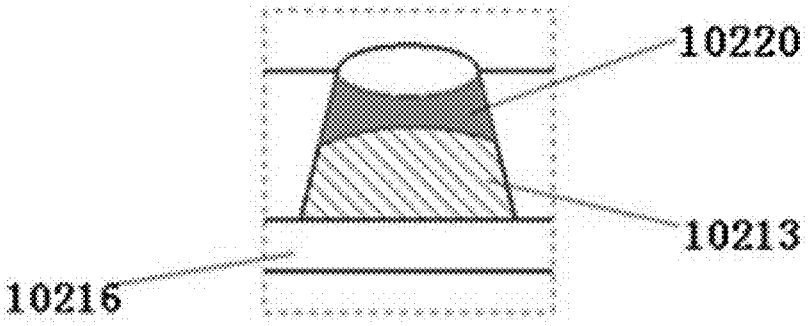
FIG. 9B is an enlarged view showing the structure of the liquid storage chamber in FIG. 9A.
Figure 10:
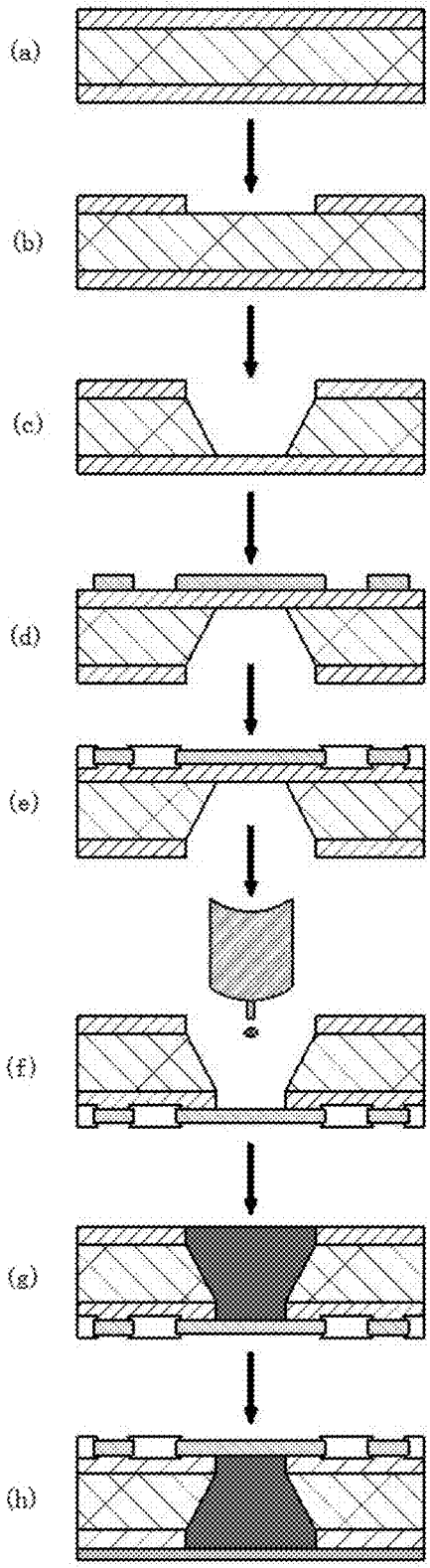
FIG. 10 is a schematic diagram showing the manufacturing process of the silicon-based liquid storage chip, wherein the sealing film of the liquid storage chamber is a metal film.
Figure 11:
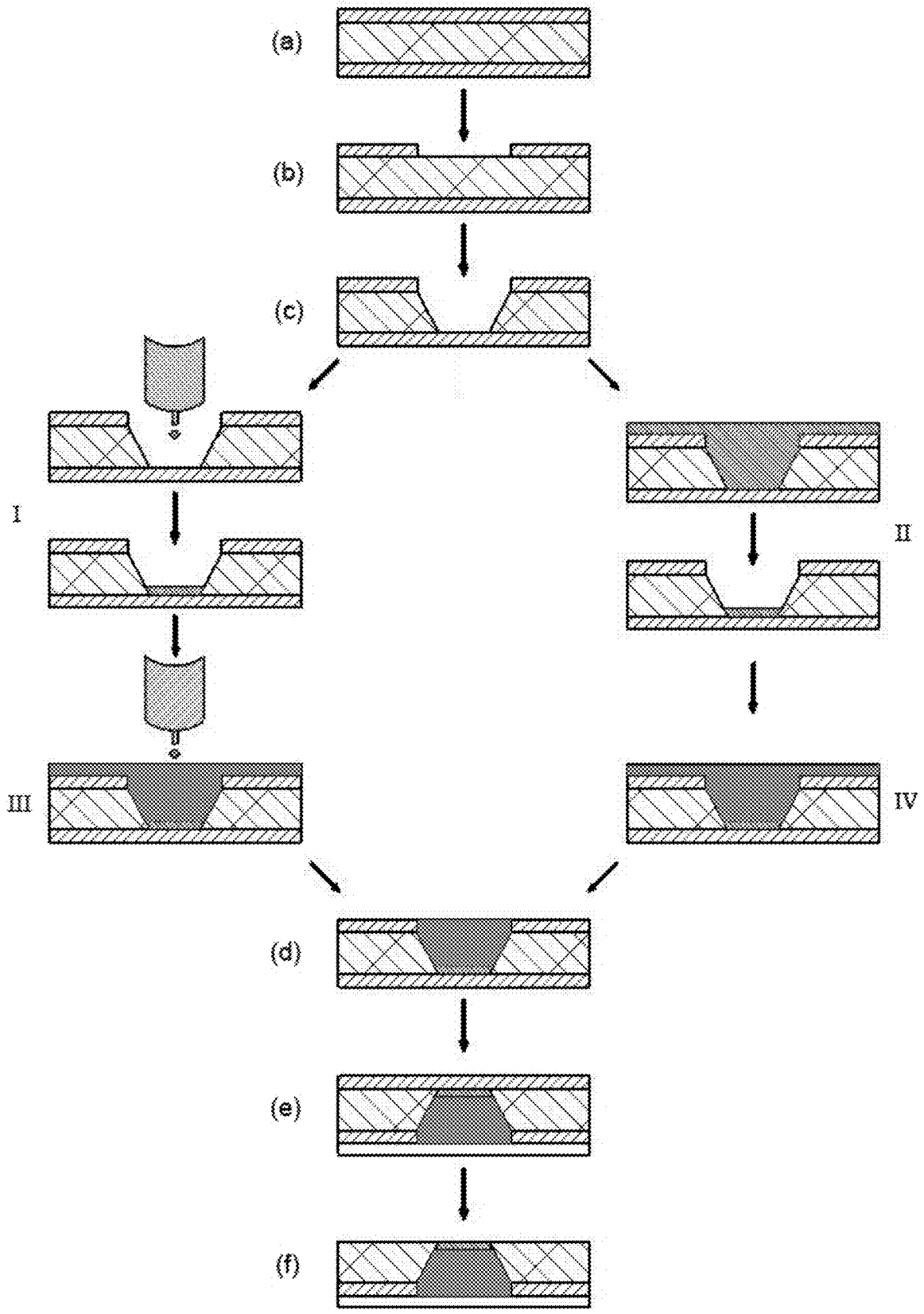
FIG. 11 is a schematic diagram showing the manufacturing process of the silicon-based liquid storage chip, wherein the sealing film of the liquid storage chamber is a polymer film.
Figure 12:
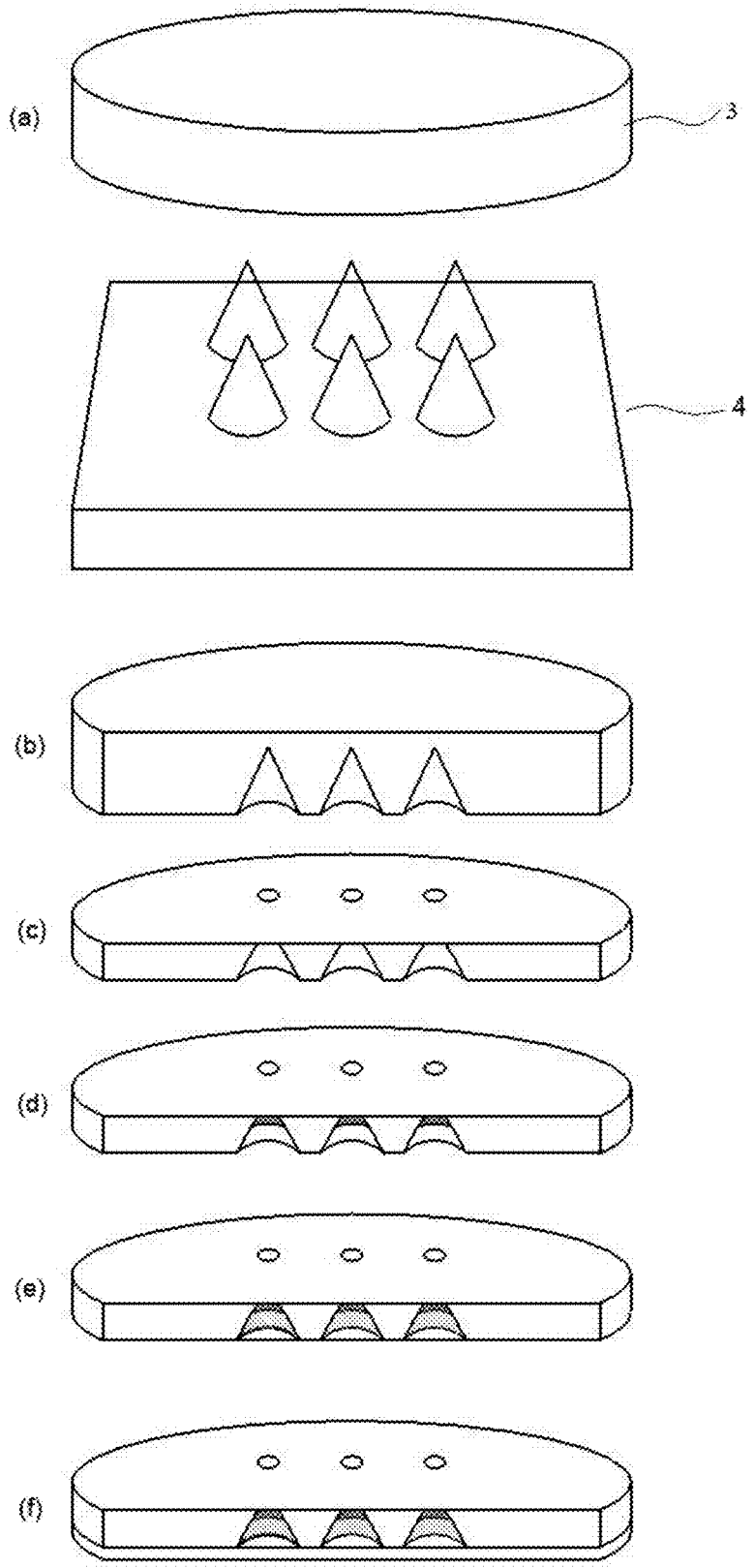
FIG. 12 is a schematic diagram showing the manufacturing process of the polymer-based liquid storage chip, wherein the sealing film of the liquid storage chamber is the polymer film.

In the present embodiment, the liquid storage chip 1021 includes the polymer substrate layer 10221 and the insulating sealing layer 10216, as shown in FIG. 9. The polymer substrate layer 10221 is provided with the plurality of liquid storage chambers 10214 which penetrate the polymer substrate layer 10221. The open end of the liquid storage chamber 10214 is sealed and fixed by a film, and the closed end of the liquid storage chamber 10214 is provided with the e-liquid injection hole 10218.

What is claimed is:

1. An electronic cigarette with an improved atomizer, comprising:

an atomizing core;

wherein the atomizing core comprises a liquid storage assembly and a heating assembly;

the liquid storage assembly comprises a liquid storage chip, a PCB, and a liquid storage chip support;

the liquid storage chip support is provided with a PCB receiving groove configured to receive the PCB; the liquid storage chip is fixed on the PCB;

the heating assembly comprises a heating element and a heating element support;

a pin is arranged on the heating element; the heating element support is provided with a heating element receiving groove and a second air guide hole, wherein the heating element receiving groove is configured to receive the heating element; a pin hole is arranged on a wall of the heating element receiving groove; the pin passes through the pin hole, so that the heating element is movably connected to the heating element support the liquid storage chip is arranged corresponding to the heating element.

2. The electronic cigarette with the improved atomizer according to claim 1, wherein, the liquid storage chip comprises an insulating layer, a silicon substrate layer, and an insulating sealing layer in sequence; or the liquid storage chip comprises the insulating layer, a polymer substrate layer, and the insulating sealing layer in sequence; the liquid storage chip is provided with a plurality of liquid storage chambers, wherein the plurality of liquid storage chambers penetrate the insulating layer and the silicon substrate layer, or the plurality of liquid storage chambers penetrate the insulating layer and the polymer substrate layer; an open end of each of the plurality of liquid storage chambers is sealed and fixed by a film; a closed end of each of the plurality of liquid storage chambers is provided with an e-liquid injection hole.

3. The electronic cigarette with the improved atomizer according to claim 1, wherein, the liquid storage chip comprises a polymer substrate layer and an insulating sealing layer; the polymer substrate layer is provided with a plurality of liquid storage chambers penetrating the polymer substrate layer; an open end of each of the plurality of liquid storage chambers is sealed and fixed by a film; a closed end of each of the plurality of liquid storage chambers is provided with an e-liquid injection hole.

4. The electronic cigarette with the improved atomizer according to claim 2, wherein, the film used at the open end of each of the plurality of liquid storage chambers is a metal film or a polymer film.

5. The electronic cigarette with the improved atomizer according to claim 1, wherein, the heating element is an integral heating element or a heating unit array; wherein the heating unit array comprises a plurality of microneedle heating units, and each of the plurality of microneedle heating units operates separately.

6. The electronic cigarette with the improved atomizer according to claim 4, wherein, the metal film is connected to a cathode and an anode of a power supply.

7. The electronic cigarette with the improved atomizer according to claim 3, wherein, the film used at the open end of each of the plurality of liquid storage chambers is a metal film or a polymer film.

8. The electronic cigarette with the improved atomizer according to claim 7, wherein, the metal film is connected to a cathode and an anode of a power supply.

* * * * *